United States Patent [19]

Ohkumo et al.

[11] Patent Number: 4,598,679

[45] Date of Patent: Jul. 8, 1986

[54] FUEL CONTROL SYSTEM FOR A VEHICLE POWERED BY AN ENGINE

[75] Inventors: Hiroya Ohkumo, Koganei; Tsutomu Murakawa, Mitaka, both of Japan

[73] Assignee: Fuji Jukogyo Kabushiki Kaisha, Tokyo, Japan

[21] Appl. No.: 733,023

[22] Filed: May 13, 1985

[30] Foreign Application Priority Data

May 23, 1984 [JP] Japan ..... 59-105453

[51] Int. Cl.[4] ..... F02D 41/12

[52] U.S. Cl. ..... 123/325; 123/333

[58] Field of Search ..... 123/325, 332, 333, 493, 123/19 E, 198 DB

[56] References Cited

U.S. PATENT DOCUMENTS 4,385,596 5/1983 Hosaka ..... 123/325
4,434,759 3/1984 Iezuka et al. ..... 123/333
4,508,088 4/1985 Hasegawa et al. ..... 74/860
4,550,703 11/1985 Ootuka et al. ..... 123/325

FOREIGN PATENT DOCUMENTS 44-19485 8/1969 Japan .
54-14826 6/1979 Japan .

*Primary Examiner*—William A. Cuchlinski, Jr.
*Attorney, Agent, or Firm*—Martin A. Farber

[57] ABSTRACT

A fuel control system for a motor vehicle has an accelerator pedal switch for detecting deceleration of the vehicle, an engine speed detecting circuit for detecting high engine speed and low engine speed. The system has gate circuits responsive to the outputs of the accelerator pedal switch and engine speed detecting circuit at high engine speed for producing a signal for cutting off fuel supplied to cylinders of the engine, and to responsive to the output of the engine speed detecting circuit at low engine speed for intermittently supplying the fuel and thereafter for continuously supplying the fuel.

6 Claims, 4 Drawing Figures

(a)

(b)

FUEL CONTROL SYSTEM FOR A VEHICLE POWERED BY AN ENGINE

BACKGROUND OF THE INVENTION

The present invention relates to a fuel control system for a vehicle powered by an internal combustion engine, and more particularly to a system for interrupting the fuel supply at deceleration of the vehicle and for resupplying fuel at a low engine speed.

In order to improve fuel consumption and emission control of an automotive engine mounted on a motor vehicle, a system for cutting off the fuel supplied to cylinders of the engine at deceleration to idle the cylinders has been proposed. Japanese Utility Model Publication No. 54-14826 discloses a fuel control system which operates to reduce the amount of the fuel supply to a very small value during the deceleration of the vehicle without cutting off the fuel, in order to ensure the reacceleration. However, the fuel supply during the deceleration does not contribute to fuel economy and emission control. Moreover, the small amount of fuel supply causes the air-fuel mixture to dilute, which will result in increase of $NO_x$ in exhaust gases.

Japanese Patent Publication No. 44-19485 discloses a fuel cut off system which operates to resupply the fuel when engine speed decreases to a predetermined value. However, when a large amount of fuel is suddenly supplied, the torque of the engine rapidly increases, which causes a sudden acceleration to give shock to the driver.

SUMMARY OF THE INVENTION

An object of the present invention is to provide a fuel control system which may decrease the shock at the resupply of the fuel when engine speed decreases to a predetermined low speed.

Another object of the present invention is to provide a system which prevents increase of $NO_x$ in exhaust gases, caused by lean air-fuel mixture.

In accordance with the present invention, a control system operates to intermittently supply fuel when engine speed decreases below a predetermined speed, and to continously supply the fuel when the engine speed decreases below a predetermined further low speed.

According to the present invention, there is provided a fuel control system for a vehicle powered by an engine having an ignition device, the vehicle having a transmission, clutch disposed between the engine and the transmission for transmitting the power of the engine to driving wheels of the vehicle, and an accelerator pedal for accelerating the vehicle.

The system comprises fuel cut off means for cutting off fuel supplied to cylinders of the engine, a first sensor responsive to operation of the accelerator pedal for producing an output signal, an engine speed sensor for producing an engine speed signal in accordance with engine speed, first means responsive to the engine speed signal for producing a first engine speed signal, when the engine speed is higher than a predetermined high speed and for producing a second engine speed signal when the engine speed is lower than a predetermined low speed, second means responsive to the output signal of the first sensor and first engine speed signal at releasing of the accelerator pedal for producing a fuel cut off signal for operating the fuel cut off means, third means responsive to the inverted signal of the first engine speed signal for intermittently operating the fuel cut off means so as to intermittently supplying the fuel, and fourth means responsive to the second engine speed signal for disabling the fuel cut off means so as to continuously supply the fuel to cylinders of the engine.

In an aspect of the present invention, fuel control system further comprises fifth means for controlling the third means so as to supply the fuel during the intake stroke of a selected cylinder.

The other objects and features of this invention will be apparently understood from the following description with reference to the accompanying drawings.

DETAILED DESCRIPTION OF THE PREFERRED EMBODIMENT

Figure 1:
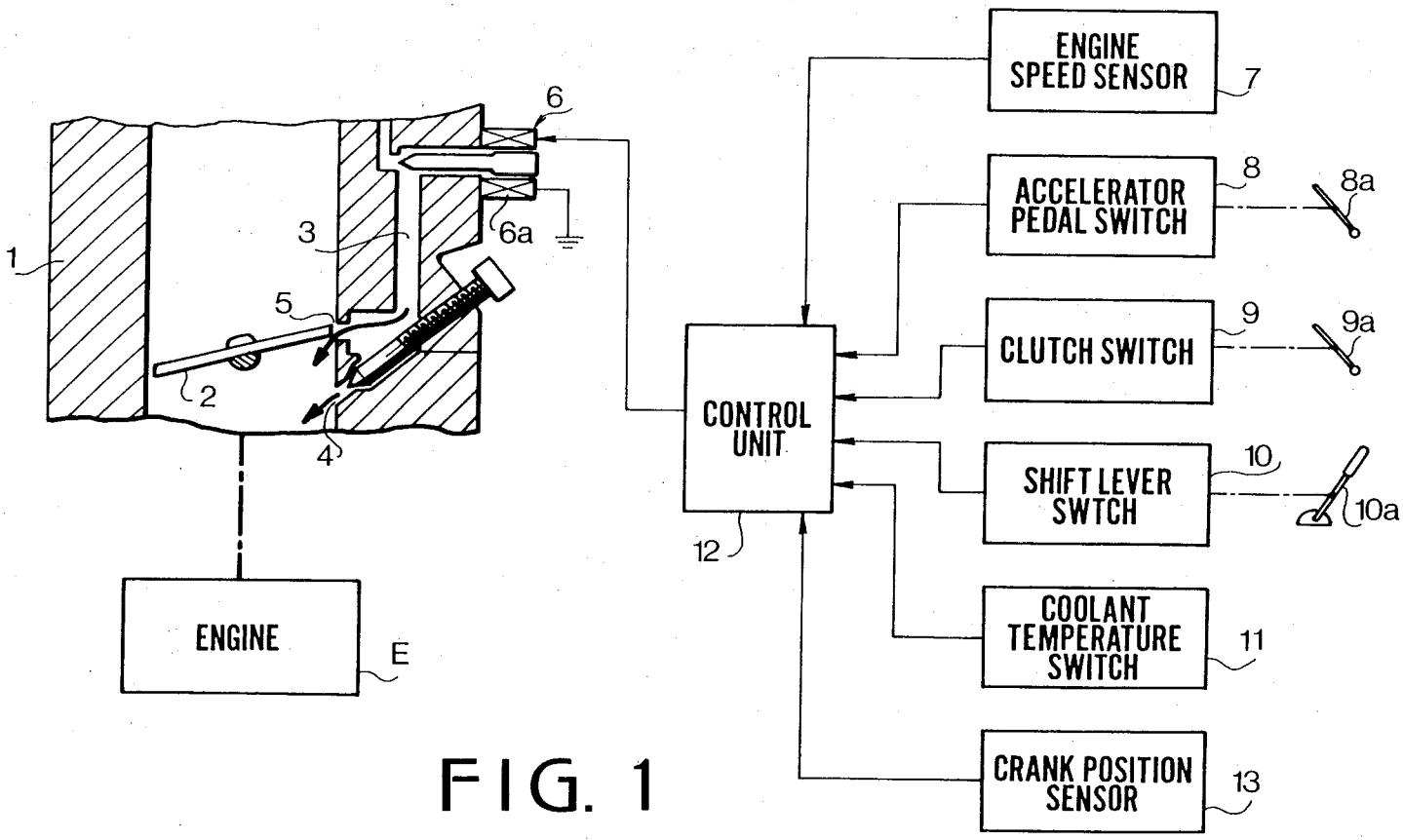
FIG. 1 is a schematic diagram showing a system of the present invention.

Referring to FIG. 1, an engine E mounted on a vehicle is provided with a carburetor 1 having a throttle valve 2, a fuel passage 3, an idle port 4 and a slow speed port 5. A solenoid operated slow cut off valve 6 is provided to close the fuel passage 3. Further, in order to decide fuel cut off conditions, the engine is provided with an engine speed sensor 7 which produces pulses in proportion to the rotational speed of a crankshaft of the engine, an accelerator pedal switch 8 for detecting the release of an accelerator pedal 8*a*, a clutch pedal switch 9 operated by a clutch pedal 9*a* for detecting the engagement of a clutch of the vehicle, a shift lever switch 10 for detecting the position of a shift lever 10*a* of a transmission, a coolant temperature switch 11 for detecting the warming-up condition of the engine, and a crank position sensor 13 for detecting a specific angular position of the crankshaft, for example the top dead center on the compression stroke at a selected cylinder. The shift lever switch 10 produces a high level signal when the shift lever is at a gear engaging position. Signals from these switches and sensors are applied to a control unit 12 for operating a solenoid 6*a* of the slow cut off valve 6.

Figure 2:
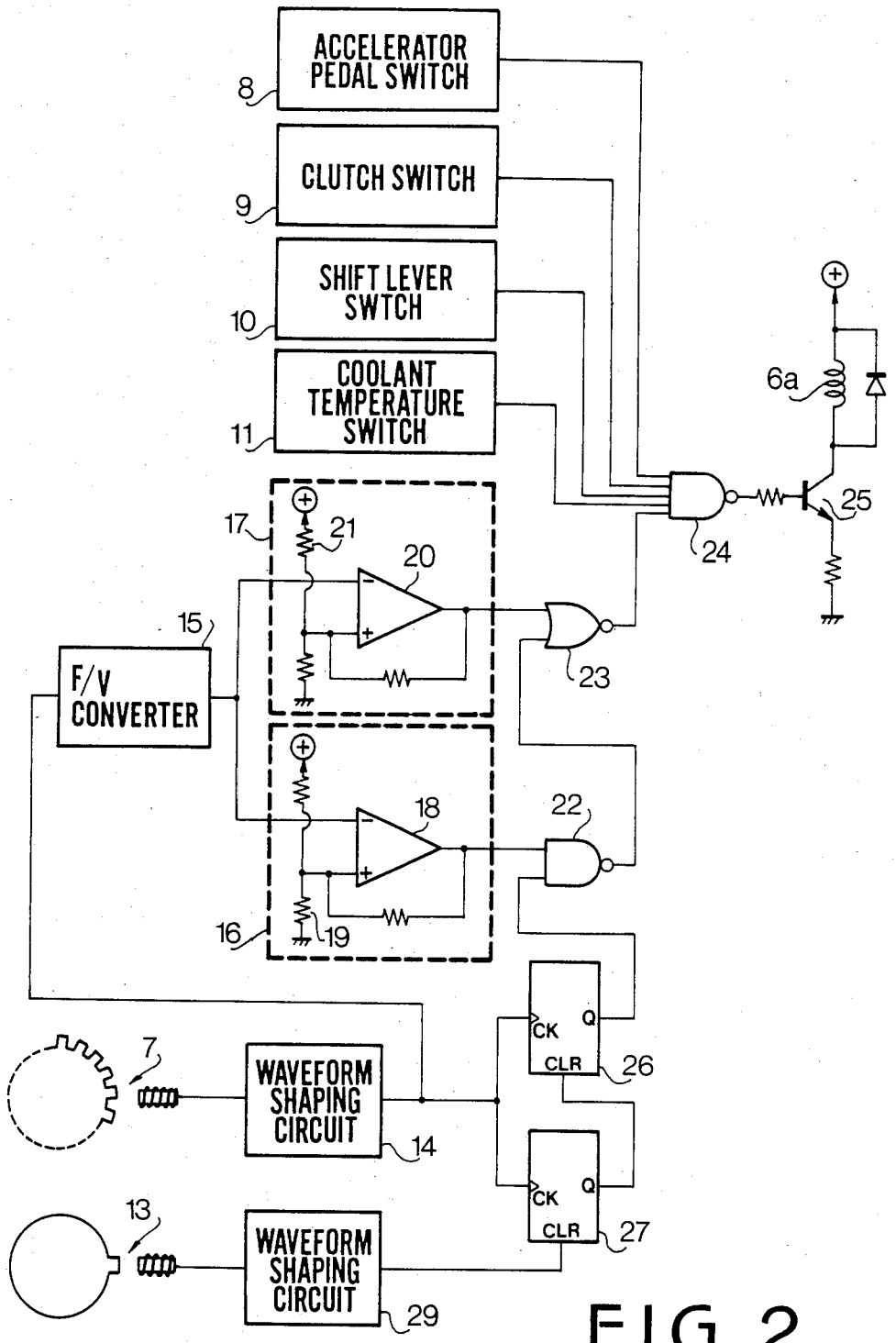
FIG. 2 shows a circuit of a control unit in the system of FIG. 1.

The control unit 12 will now be explained in detail with reference to FIG. 2. The accelerator switch 8 produces a high level signal upon the release of the accelerator pedal, the clutch switch 9 produces a high level signal at the engaging of the clutch. The output of the engine speed sensor 7 is connected to comparing circuits 16 and 17 through an waveform shaping circuit 14 and an F/V converter 15 which converts the crankangle signal into voltage corresponding to engine speed. The comparing circuit 16 comprises a comparator 18 and a voltage divider 19 for applying a reference voltage to the comparator. The reference voltage corresponds to the engine rotational speed $N_1$ at which the fuel is resupplied. The comparator 18 produces a low level signal in the range of the rotational speed higher than the speed $N_1$, while produces a high level signal when the speed is lower than the speed $N_1$. The comparing circuit 17 also comprises a comparator 20 and a voltage divider 21 for applying a reference voltage corresponding to the engine rotational speed $N_2$ lower than the speed $N_1$. The output of comparator 18 is connected to an AND gate 22, the output of which and the output of comparator 20 are applied to a NAND gate 24 through a NOR gate 23. Each of the above-described switches 8,9,10 and 11 is coupled to the NAND gate 24 for deciding the fuel cut of or fuel resupplying conditions. The output of the NAND gate 24 is connected to a base of a transistor 25 which is connected to the solenoid 6*a* of slow cut off valve 6 in series.

The output of the waveform shaping circuit 14 is also coupled to preset counters 26 and 27. The counters 26 and 27 produce output signals at respective set counts from Q terminals. The Q terminal of counter 27 is connected to the clear terminal of counter 26, while the Q terminal of the counter 26 is coupled to the other input of AND gate 22. The crank position sensor 13 is connected to the clear terminal of counter 27 through an waveform shaping circuit 29.

Figure 3:
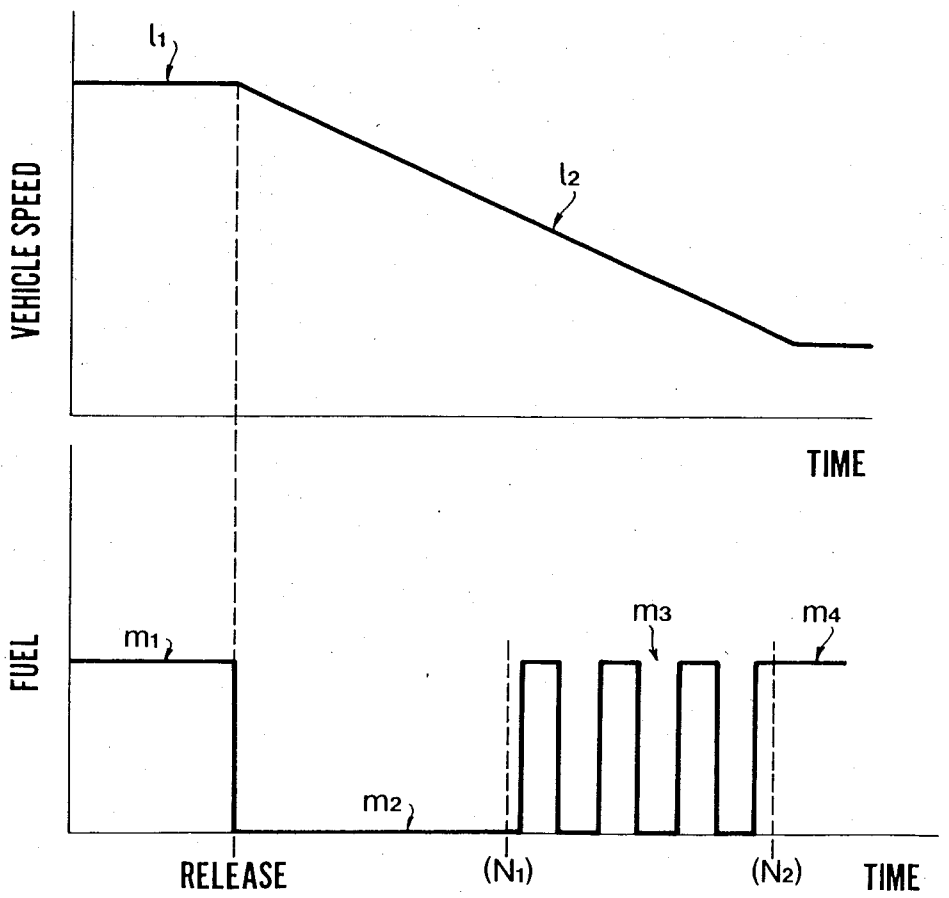
FIG. 3*a* and 3*b* show graphs for explaining the operation of the system.

In operation, when one of speed gears in the transmission is engaged with a corresponding gear and the clutch is engaged under the warming-up condition of the engine, switches 9, 10 and 11 produce high level outputs. When the accelerator pedal is depressed at a vehicle speed $1_1$ (FIG. 3*a*), the accelerator pedal switch 8 produces a low level signal. Accordingly, the NAND gate 24 produces a high level output regardless of the engine speed, so that the transistor 25 is conducted to excite the solenoid 6*a* to open the passage 3. Consequently, a usual fuel supply is performed as indicated by $m_1$ in FIG. 3*b*. When the accelerator pedal is released, the switch 8 produces a high level signal, and the other hand, vehicle speed decreases as shown by $1_2$ of FIG. 3*a*. At that time, when the engine speed is higher than the speed $N_1$, low level output signals are produced from both comparing circuits 16 and 17, so that the AND gate 22 produces a low level signal. Accordingly, the NOR gate 23 produces a high level signal. Therefore, all of input signal of the NAND gate 24 become high, causing the output of the gate to go to a low level. Thus, the transistor 25 is turned off to de-energize solenoid 6*a* to close the valve 6. Thus, the fuel is cut off as indicated by $m_2$ in FIG. 3*b*.

When the engine speed decreases below the speed $N_1$, the output of the comparing circuit 16 goes to a high level to open the AND gate 22. On the other hand, the counters 26 and 27 count the pulses from the engine speed sensor 17. The counter 26 is preset to produce an output when an intake valve at a selected cylinder opens, and the counter 27 is preset to produce an output when the intake valve closes. Accordingly, the counter 26 produces a high level output when the intake valve opens, so that the AND gate 22 produces an output. The output is inverted by the NOR gate 23, causing the output of the NAND gate 24 to go to a high level. Thus, the solenoid 6*a* is energized to open the valve 6. The counter 27 produces an output at the close of the close of the intake value to clear the counter 26. Thus, the output of the AND gate 22 goes to a low level, thereby closing the valve 6. The counter 27 is reset by the signal from the crank position sensor 13. Accordingly, the fuel is intermittently supplied to the selected cylinder during the opening of the intake valve at every intake stroke, as shown by $m_3$ in FIG. 3*b*.

When the engine speed decreases below the speed $N_2$, the output of the comparator 20 becomes high which is inverted by the NOR gate 23. Thus, the output of the NAND gate 24 goes to a high level to energize the solenoid, thereby supplying the fuel continuously as shown by $m_4$ in FIG. 3*b*.

When the clutch is disengaged or the accelerator pedal is depressed during the fuel cut off period or fuel intermittent supply period, the fuel is resupplied by the inversion of the signal from the switch 9 or 8.

It is to be understood that the present invention is not limited to the embodiment described above and that, for example, ignition pulses can be employed instead of the engine speed sensor and the period of the fuel on-off control operation may be decided by using of a timer. Also it is to be understood that this invention can be applied to an engine having fuel injectors and further a microcomputer system may be employed as a control system.

From the foregoing, it will be understood that the present invention provides a fuel control system which operates to intermittently supply the fuel at first for restarting the engine, thereafter the fuel is continously supplied. Accordingly, the rising of engine torque due to the fuel resupply may be smoothed and the recovery shock is reduced. At the on-off control of fuel supplying, the fuel may be smoothly introduced into the selected cylinder by signals synchronized with the engine operation in such a manner as corresponding to the timing of opening of the intake valve. The fuel thus introduced into the selected cylinder may be maintained at a relatively lower air-fuel ratio, and thus the amount of $NO_x$ can be reduced.

While the presently referred embodiment of the present invention has been shown and described, it is to be understood that this disclosure is for the purpose of illustration and that various changes and modifications may be made without departing from the spirit and scope of the invention as set forth in the appended claim.

What is claimed is:

1. In a fuel control system for a vehicle powered by an engine having an ignition device, the vehicle having a transmission, a clutch disposed between the engine and the transmission for transmitting the power of the engine to driving wheels of the vehicle, and an accelerator pedal for accelerating the vehicle, the improvement comprising:

fuel cut off means for cutting off fuel supplied to cylinders of the engine;

a first sensor responsive to operation of the accelerator pedal for producing an output signal;

an engine speed sensor for producing an engine speed signal in accordance with engine speed;

first means responsive to the engine speed signal for producing first engine speed signal when the engine speed is higher than a first predetermined speed and for producing a second engine speed signal when the engine speed is lower than a second predetermined speed;

second means responsive to the output signal of the first sensor and the first engine speed signal at releasing of the accelerator pedal for producing a fuel cut off signal for operating the fuel cut off means;

third means responsive to an inverted signal of the first engine speed signal for intermittently operating the fuel cut off means so as to intermittently supplying the fuel; and fourth means responsive to the second engine speed signal for disabling the fuel cut off means so as to continuously supply the fuel to cylinders of the engine.

2. The fuel control system according to claim 1 further comprising fifth means for controlling the third means so as to supply the fuel during the intake stroke of a selected cylinder.

3. The fuel control system according to claim 2 wherein the engine speed sensor is a pulse generator for producing pulses in proportion to the engine speed.

4. The fuel control system according to claim 3 wherein the the second, third and fourth means are logic gate means.

5. The fuel control system according to claim 4 wherein the fifth means comprises counter means for counting pulses from the engine speed sensor and for producing a signal for opening the logic gate means of the third means during the intake stroke.

6. The fuel control system according to claim 1 wherein the first means comprises a pair of comparing circuits.

* * * * *